US012022930B1

(12) United States Patent
Liu

(10) Patent No.: US 12,022,930 B1
(45) Date of Patent: Jul. 2, 2024

(54) LIPSTICK CONTAINER HAVING LIGHT AND REPLACEABLE LIPSTICK TUBE

(71) Applicant: Zhuhai Ding Rong Plastic Products Co., LTD., Zhuhai (CN)

(72) Inventor: Ting Nan Liu, New Taipei (TW)

(73) Assignee: Zhuhai Ding Rong Plastic Products Co., LTD., Zhuhai (CN)

( * ) Notice: Subject to any disclaimer, the term of this patent is extended or adjusted under 35 U.S.C. 154(b) by 0 days.

(21) Appl. No.: 18/187,115

(22) Filed: Mar. 21, 2023

(51) Int. Cl.

| | |
|---|---|
| ***A45D 40/06*** | (2006.01) |
| ***A45D 40/04*** | (2006.01) |
| ***A45D 40/18*** | (2006.01) |
| *A45D 40/00* | (2006.01) |

(52) U.S. Cl.
CPC ..... *A45D 40/04* (2013.01); *A45D 40/06* (2013.01); *A45D 40/065* (2013.01); *A45D 40/18* (2013.01); *A45D 2040/0056* (2013.01); *A45D 2200/05* (2013.01)

(58) Field of Classification Search
CPC ..... A45D 40/04; A45D 40/06; A45D 40/065; A45D 40/18; A45D 2040/0056; A45D 2200/05
See application file for complete search history.

(56) References Cited

U.S. PATENT DOCUMENTS

| | | | | |
|---|---|---|---|---|
| 7,758,267 | B1 * | 7/2010 | Zhang | A45D 40/18 401/98 |
| 9,101,193 | B1 * | 8/2015 | Liu | A45D 40/00 |
| 9,974,376 | B1 * | 5/2018 | Liu | A45D 40/265 |

FOREIGN PATENT DOCUMENTS

KR 20210094967 A * 7/2021

* cited by examiner

*Primary Examiner* — Jennifer C Chiang

(57) ABSTRACT

A lipstick container includes a rotational shell; an illumination assembly including a disc; battery powered LEDs; a transparent recessed member in the shell; and a mirror in the transparent recessed member; a casing including spaced second ridges on a rim and secured to the first ridges, and a well; a lipstick tube in the casing and including a rotational member, two internal opposite curved protrusions, two gaps between the protrusions, and two raised blocks on the protrusions respectively; a joining device including projections in the well and a rear first shoulder; a locking device including a seat, two opposite protuberances on an axial member with the raised blocks fastened between the protuberances and the seat, and a shaped member; and a base including a second shoulder secured to the first shoulder, and an internally shaped projecting member secured to the shaped member.

12 Claims, 13 Drawing Sheets

LIPSTICK CONTAINER HAVING LIGHT AND REPLACEABLE LIPSTICK TUBE

FIELD OF THE INVENTION

The invention relates to cosmetic containers and more particularly to a lipstick container having a light and a replaceable lipstick tube.

BACKGROUND OF THE INVENTION

Conventional lipstick tubes are intended to be thrown away after the lipstick has been consumed. However, this is not environment friendly and may harm the environment. For overcoming the drawbacks, a lipstick container with a replaceable lipstick was invented by the present inventor. In detail, the lipstick container comprises a cap, a lipstick tube, a joining device and a seat. The seat is provided with an axial shaft. A rotation of the seat may disengage the shaft from both the lipstick tube and the joining device so that the lipstick tube can be replaced by a new one. Therefore, the purpose of reusing the lipstick container is achieved. However, the conventional lipstick container is not provided with a mirror and a light. It is typical that a user may carry a mirror and use the lipstick container in an illuminated environment.

Thus, the need for improvement still exists.

SUMMARY OF THE INVENTION

It is therefore one object of the invention to provide a lipstick container comprising a rotational shell including a plurality of spaced first ridges on an inner surface; an illumination assembly including a battery receptacle disposed in the rotational shell and having a disc-shaped member, a hollow cylinder formed with the disc-shaped member, a receiving space disposed in the hollow cylinder; at least one light-emitting member disposed on a first surface of the disc-shaped member; a battery disposed in the receiving space and electrically connected to the at least one light-emitting member; a transparent recessed member disposed in the rotational shell and above the battery receptacle; and a mirror disposed in the transparent recessed member; a casing including a rim extending out of a forward end, a plurality of spaced second ridges disposed on the rim and configured to secure to the first ridges, a channel disposed through the casing with the hollow cylinder disposed therein, and a well disposed on an inner surface of a rear end; a lipstick tube disposed in the casing and including a rotational member proximate a rear end, a tunnel disposed through the lipstick tube, two opposite curved protrusions disposed on an inner surface of the tunnel at the rear end, two gaps each disposed between first ends of the curved protrusions or between second ends of the curved protrusions, and two raised blocks each disposed on the curved protrusion adjacent to the gap; a joining device including a plurality of spaced projections formed on a forward extension and configured to dispose in the well, and a first shoulder at a rear end; a locking device including a seat, an axial member extending out of a forward end of the seat, two opposite protuberances formed on the axial member with the raised blocks fastened between the opposite protuberances and the seat, and a shaped member formed on a rear end of the seat; and a base including a second shoulder configured to secure to the first shoulder, and an internally shaped projecting member disposed on a bottom and configured to secure to the shaped member.

It is another object of the invention to provide a lipstick container comprising a rotational shell including an internal groove at an end, a plurality of spaced first ridges on an outer surface, an internal trough, and a battery disposed in the internal trough; an illumination assembly including a switch disposed in the internal groove, at least one light-emitting member disposed on a surface of the switch, a transparent recessed member disposed in the rotational shell, and a mirror disposed in the transparent recessed member wherein the switch is electrically interconnected the at least one light-emitting member and the battery; a casing including a rim extending out of a forward end, a plurality of spaced second ridges disposed on an inner surface of the rim and configured to secure to the first ridges, an annular member disposed in the rim, and a well disposed on an inner surface of a rear end wherein an outer surface of the battery urges against the annular member; a lipstick tube disposed in the casing and including a rotational member proximate a rear end, a tunnel disposed through the lipstick tube, two opposite curved protrusions disposed on an inner surface of the tunnel at the rear end, two gaps each disposed between first ends of the curved protrusions or between second ends of the curved protrusions, and two raised blocks each disposed on the curved protrusion adjacent to the gap; a joining device including a plurality of spaced projections formed on a forward extension and configured to dispose in the well, and an first shoulder at a rear end; a locking device including a seat, an axial member extending out of a forward end of the seat, two opposite protuberances formed on the axial member with the raised blocks fastened between the opposite protuberances and the seat, and a shaped member formed on a rear end of the seat; and a base including an second shoulder configured to secure to the first shoulder, and an internally shaped projecting member disposed on a bottom and configured to secure to the shaped member.

The invention has the following advantages and benefits in comparison with the conventional art:

In use a user may press the mirror which in turn presses both the transparent recessed member and the pushbutton. The switch is thus on to electrically connect the battery to the light-emitting members which are in turn activated to emit light. Finally, the light illuminates a desired target.

After use, the user may press the mirror again and in turn the mirror presses both the transparent recessed member and the pushbutton. The switch is thus off to electrically disconnect the battery from the light-emitting members. As a result, the light-emitting members are deactivated. This saves energy.

The lipstick replacement involves the steps of engaging the casing from the joining device, holding the joining device to rotate the base until the base co-rotates with the locking device, moving the protuberances into the gaps, pulling the lipstick tube out of both the locking device and the joining device, and replacing the consumed lipstick tube with a new one. In short, the lipstick container is not discarded, i.e., being reused and this is environmentally friendly.

The battery replacement involves the steps of rotating the rotational shell to disengage the illumination assembly from the casing, taking the consumed battery out of the receiving space, and replacing the battery with a new one. This is very convenient.

The above and other objects, features and advantages of the invention will become apparent from the following detailed description taken with the accompanying drawings

DETAILED DESCRIPTION OF THE INVENTION

Figure 1:
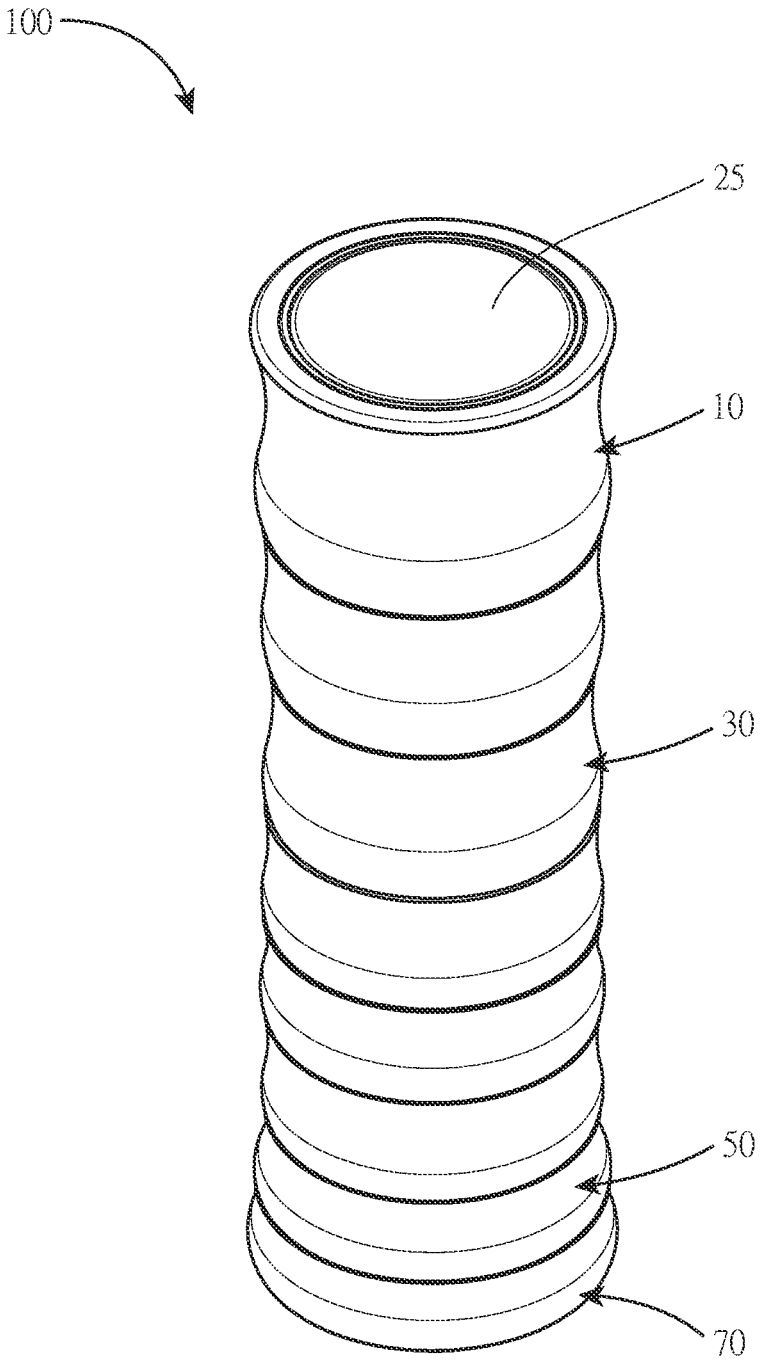
FIG. 1 is a perspective view of a lipstick container in accordance with a first preferred embodiment the invention.
Figure 2:
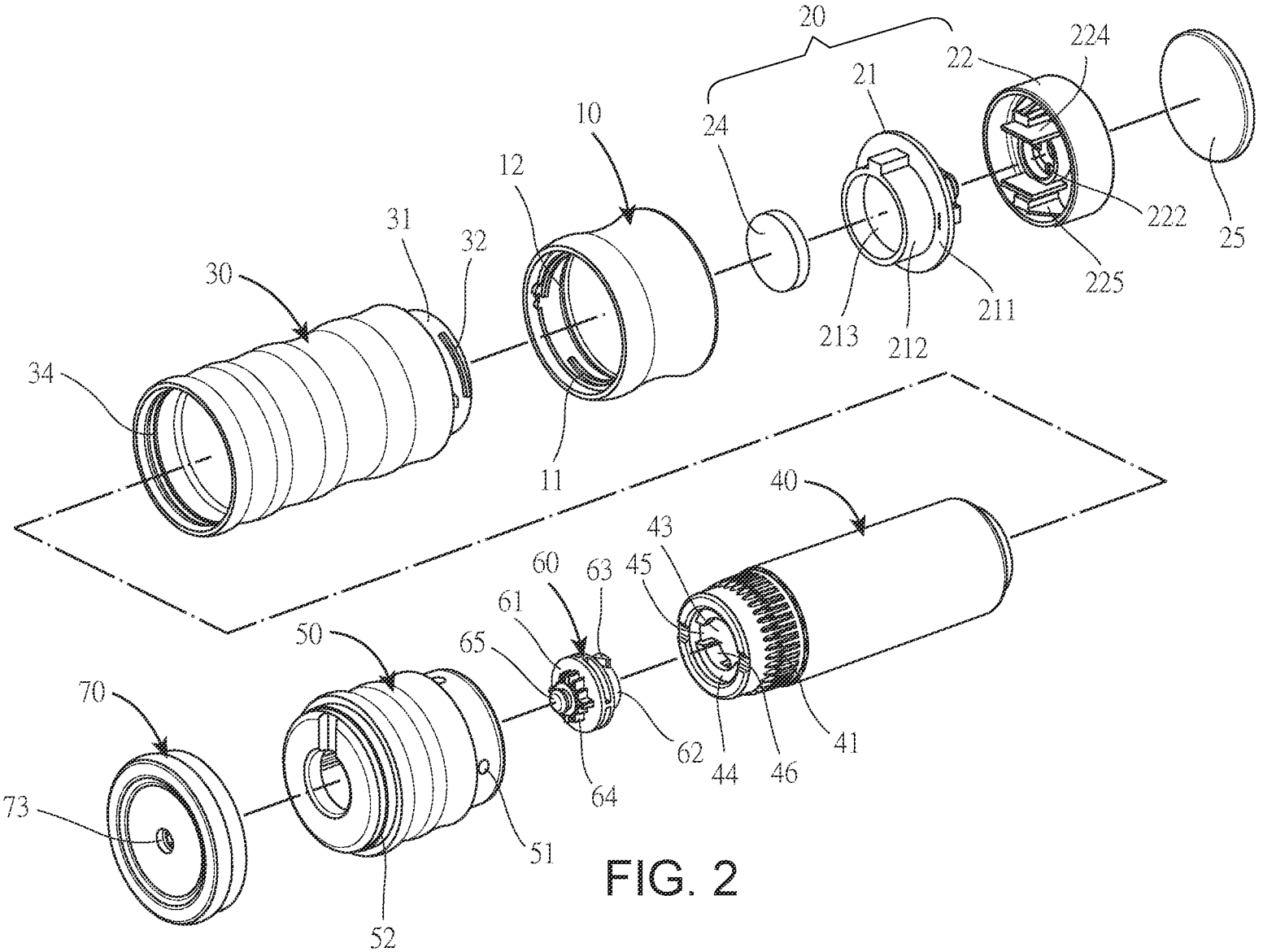
FIG. 2 is an exploded view of the lipstick container.
Figure 3:
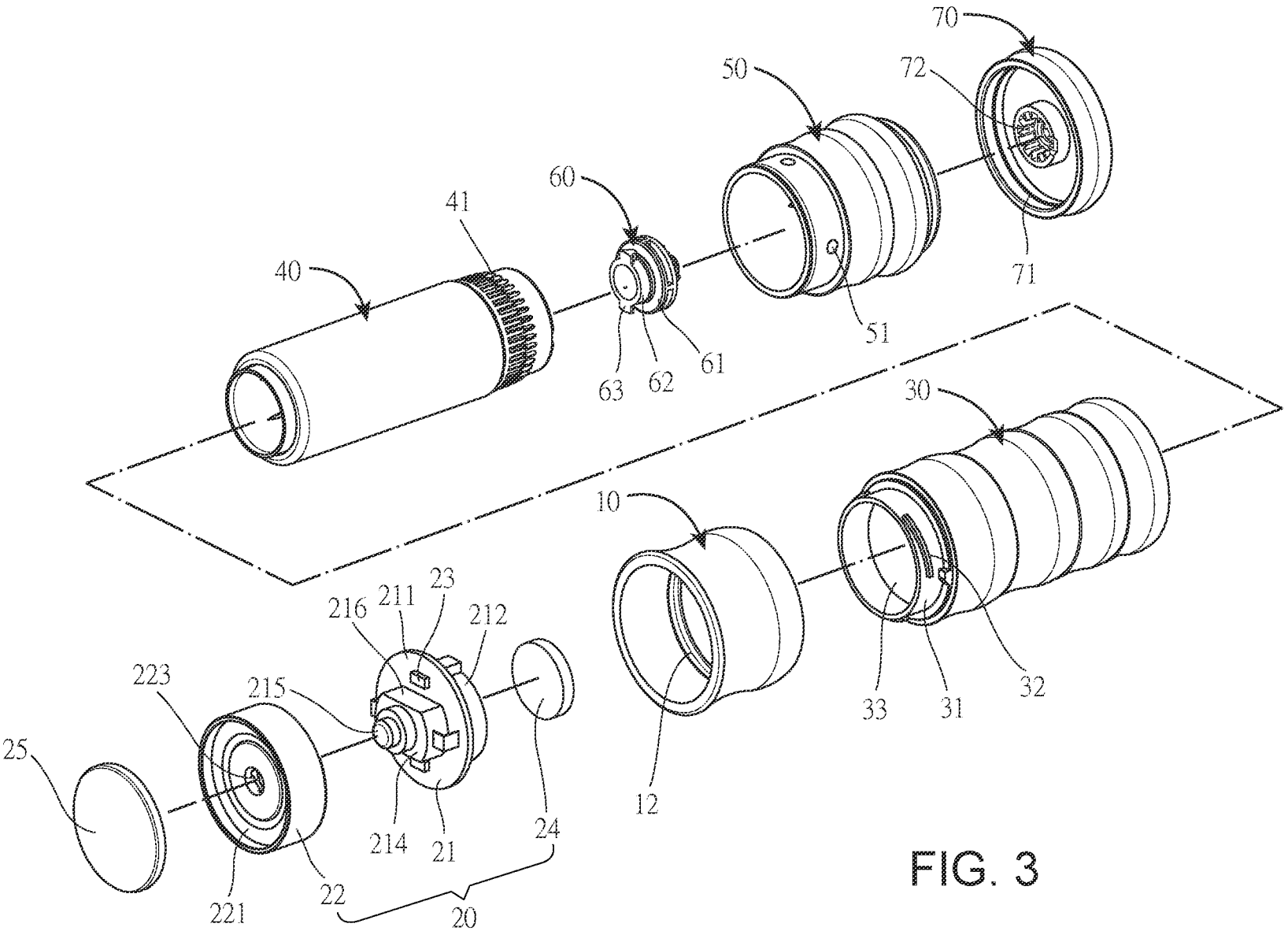
FIG. 3 is another exploded view of the lipstick container.
Figure 4:
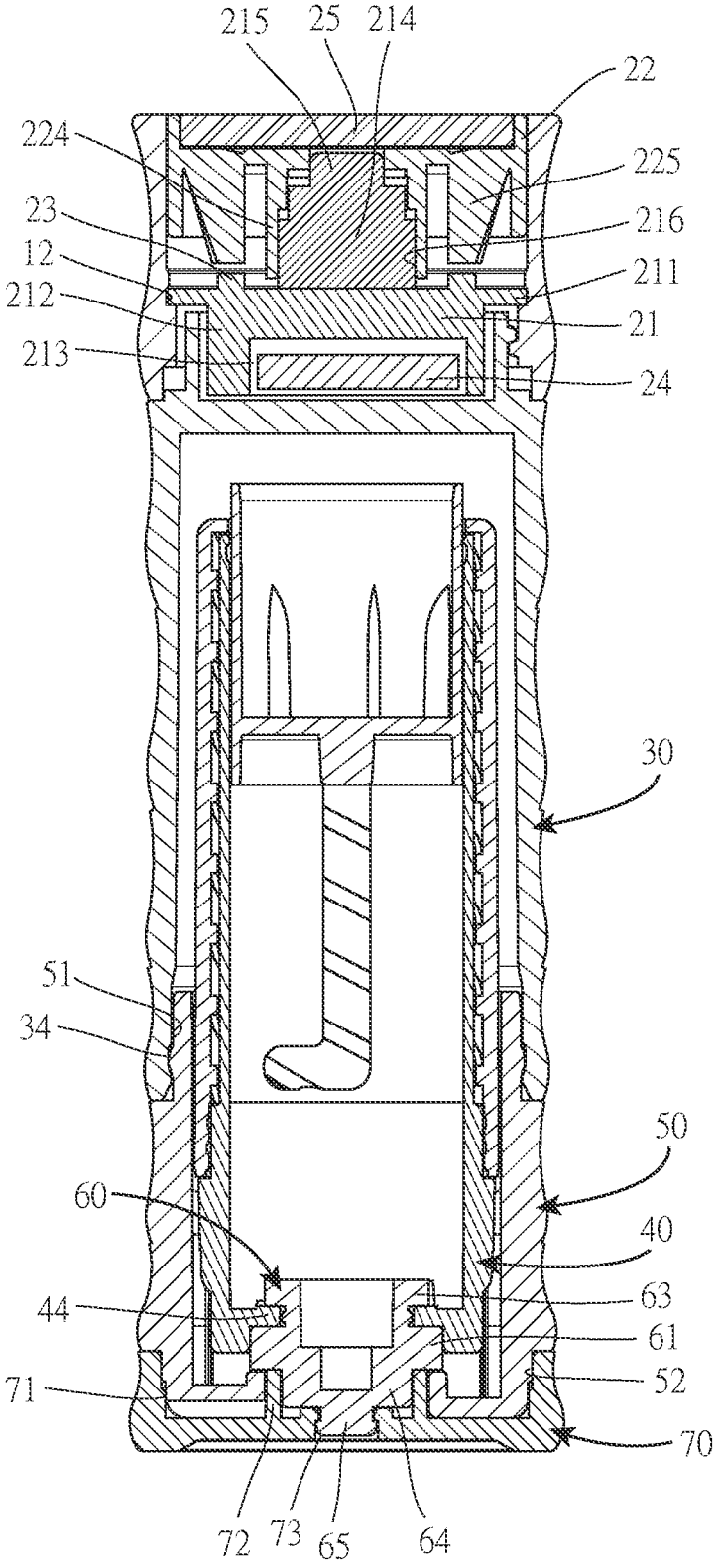
FIG. 4 is a longitudinal sectional view of the lipstick container.

Referring to FIGS. 1 to 10 and 14, a lipstick container 100 in accordance with a first preferred embodiment the invention comprises the following components as discussed in detail below.

A rotational cylindrical shell 10 includes a plurality of spaced first ridges 11 on an inner surface and a groove 12 on the inner surface adjacent to the first ridges 11.

An illumination assembly 20 includes a battery receptacle 21 disposed in the rotational cylindrical shell 10 and having a disc-shaped member 211 being a printed circuit board (PCB) and fastened in the groove 12, a hollow cylinder 212 formed with the disc-shaped member 211, a receiving space 213 in the hollow cylinder 212, a switch 214 disposed on one surface of the disc-shaped member 211, a pushbutton 215 disposed on the switch 214, and two opposite urging surfaces 216 disposed on the switch 214; two opposite light-emitting members (e.g., light-emitting diodes (LEDs)) 23 disposed on one surface of the disc-shaped member 211 with the switch 214 disposed therebetween; a disc-shaped battery 24 disposed in the receiving space 213 in which the switch 214 is electrically interconnected the light-emitting members 23 and the battery 24; a transparent recessed member 22 disposed in the rotational cylindrical shell 10 and above the battery receptacle 21, the transparent recessed member 22 having a shallow recess 221 on one surface, an annular flange 222 disposed on a central portion of the other surface, a space 223 disposed in the annular flange 222 with the pushbutton 215 disposed therein, two opposite fastening plates 224 disposed on an outer surface of the annular flange 222 and urging against the urging surfaces 216 respectively so as to secure the battery receptacle 21 and the transparent recessed member 22 together, and two opposite transparent blocks 225 each disposed between the fastening plate 224 and an inner surface of the transparent recessed member 22 and aligned with the light-emitting member 23; and a mirror 25 disposed in the shallow recess 221.

Figure 6:
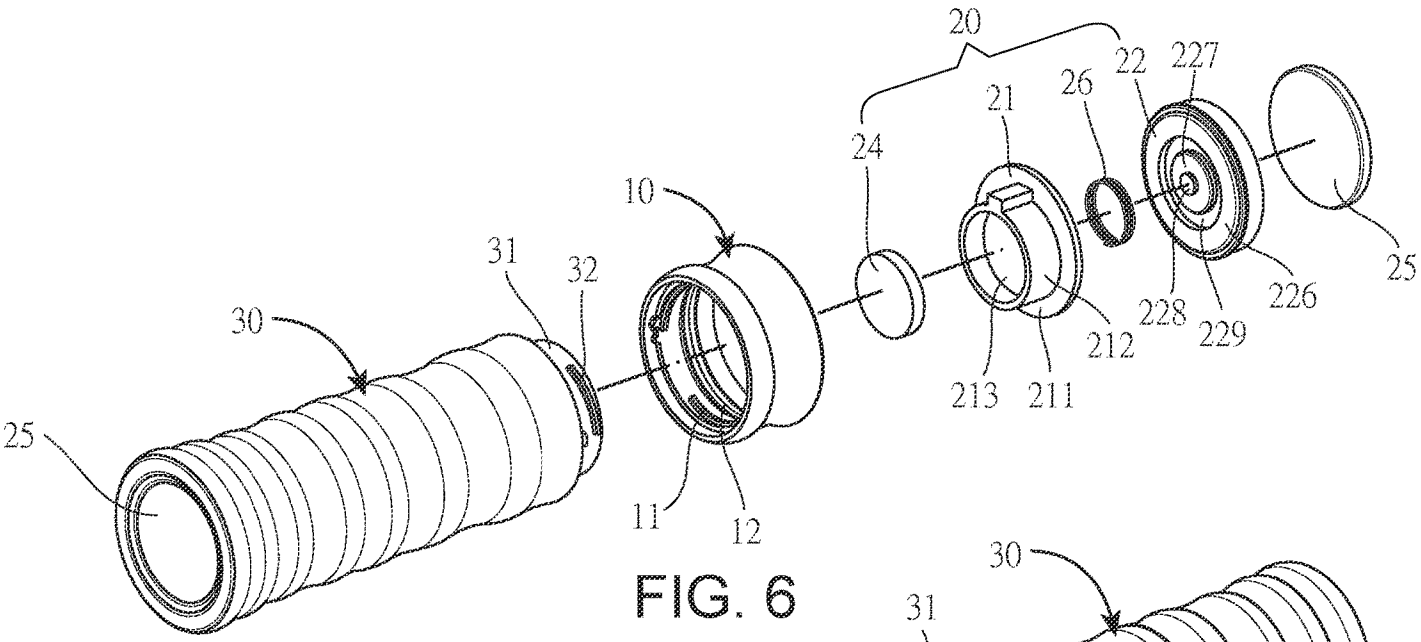
FIG. 6 is an exploded view of some components of the lipstick container of a configuration of the first preferred embodiment.
Figure 7:
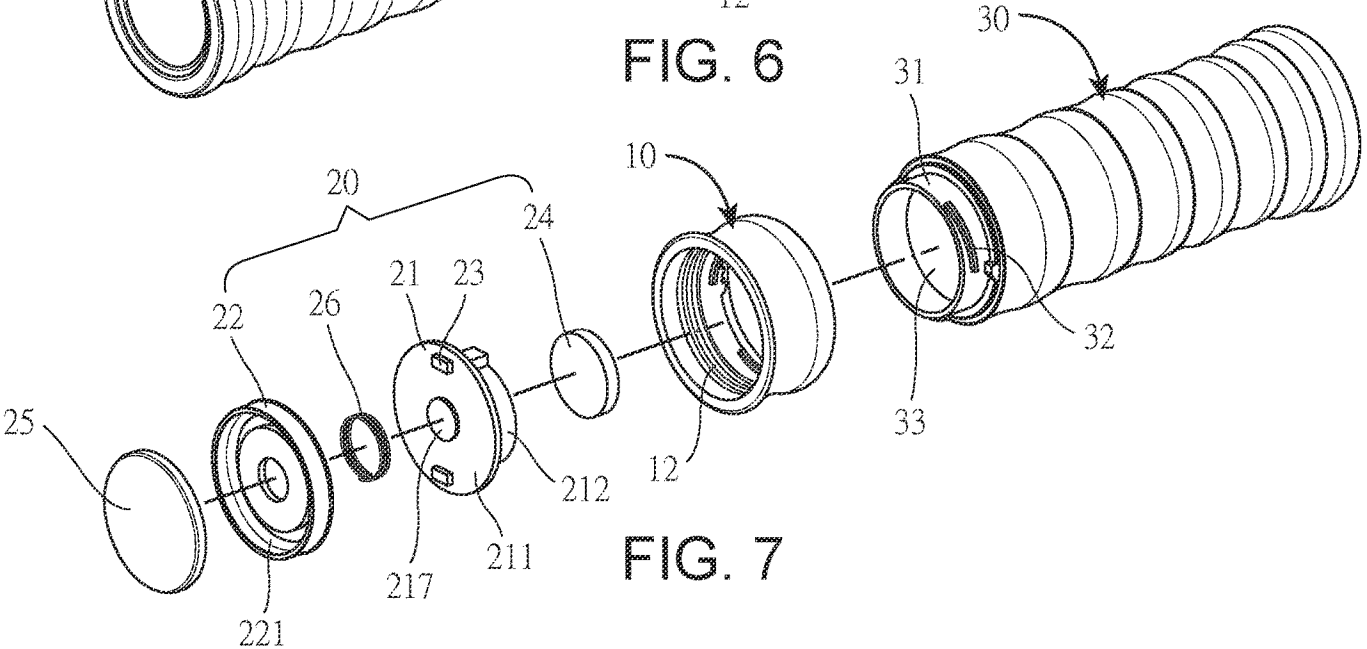
FIG. 7 is another exploded view of some components of the lipstick container of the configuration of the first preferred embodiment.
Figure 8:
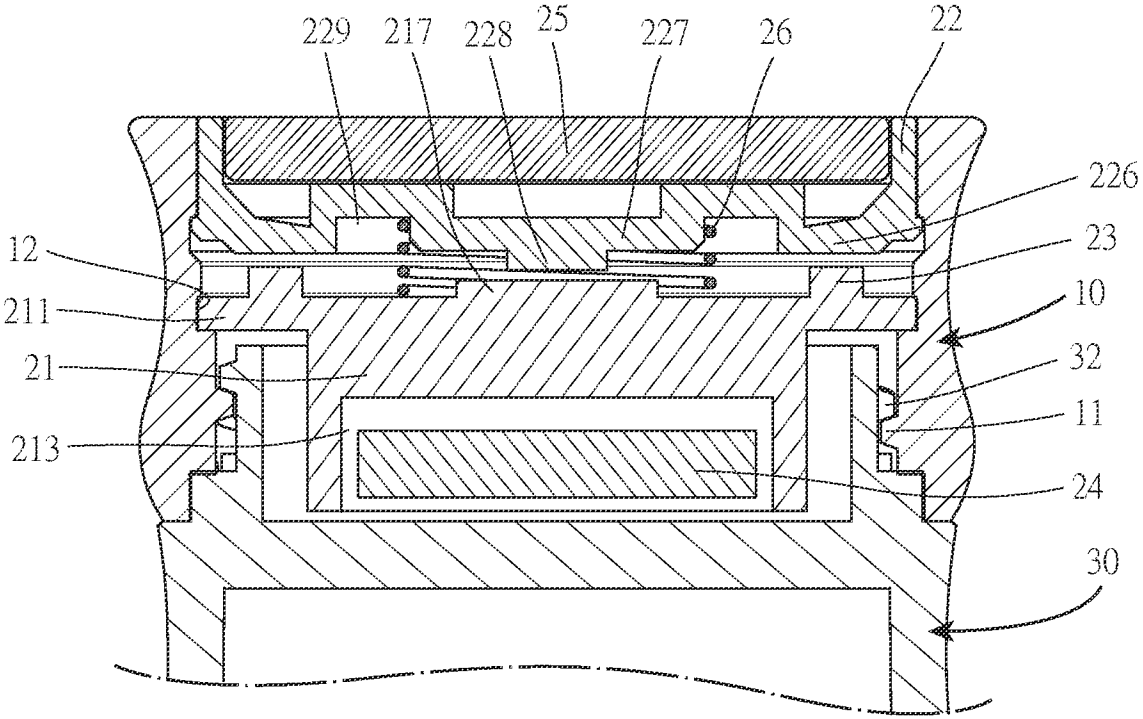
FIG. 8 is a longitudinal sectional view of an upper portion of the lipstick container of the configuration of the first preferred embodiment showing the elastic member being a helical spring.

As shown in FIGS. 6 to 8 specifically, a conductive member 217 is provided on a central portion of the disc-shaped member 211. An annular member 226 is provided on the other surface of the transparent recessed member 22, a trigger member 227 is provided in a central portion of the annular member 226, a raised trigger block 228 is provided on a central portion of the trigger member 227 aligned with the conductive member 217, an annular trough 229 is provided between the annular member 226 and the trigger member 227, and an elastic member 26 is disposed on the conductive member 217. The elastic member 26 is biased between a bottom of the annular trough 229 and a surface of the disc-shaped member 211. The elastic member 26 is a helical spring.

Figure 9:
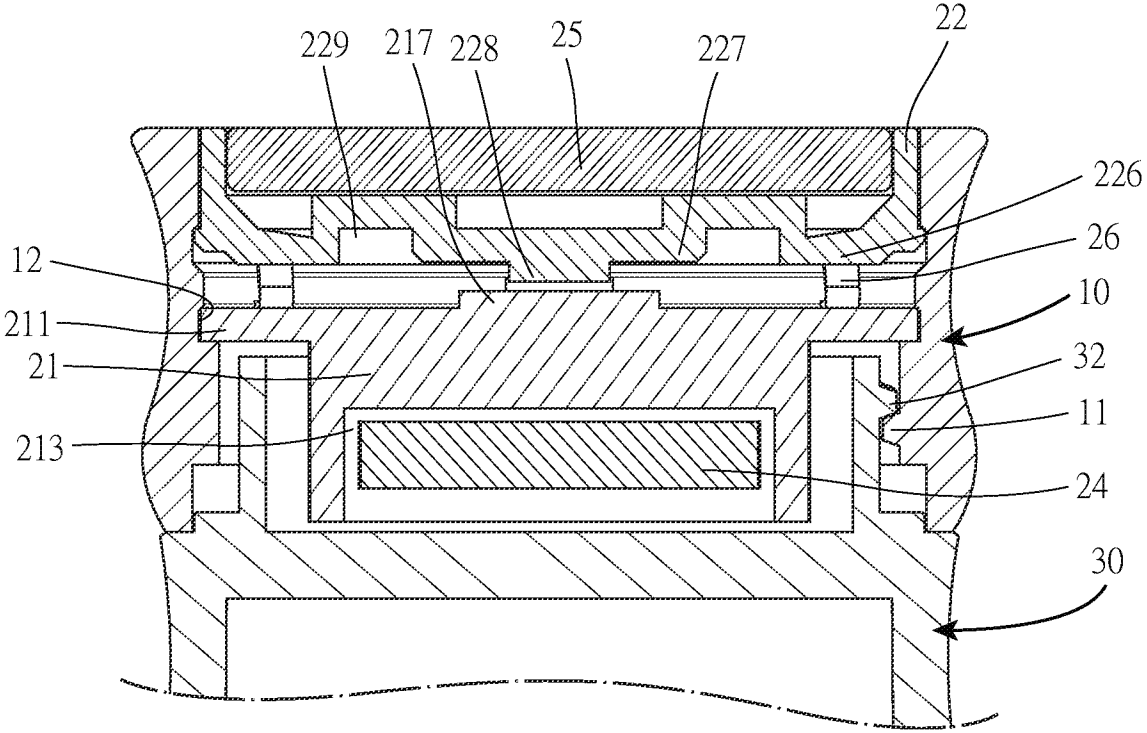
FIG. 9 is a view similar to FIG. 8 showing the elastic member being an elastic plate.

As shown in FIG. 9 specifically, one elastic member 26 is biased against one surface of the disc-shaped member 211 and spaced around the conductive member 217, and the other elastic member 26 is biased against a surface of the annular member 226. The elastic members 26 are two elastic plates.

Figure 10:
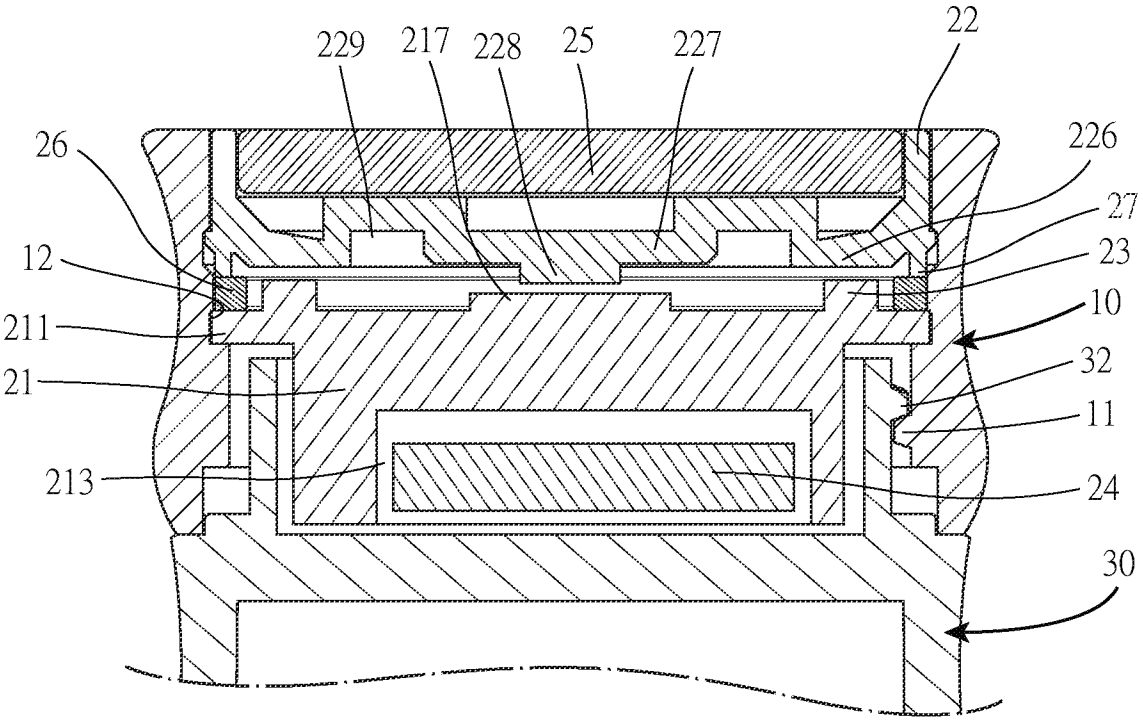
FIG. 10 is a view similar to FIG. 8 showing the elastic member being a washer.

As shown in FIG. 10 specifically, one surface of the elastic member 26 is biased against the disc-shaped member 211 and an annular flange member 27 is provided on an edge of the annular member 226. The other surface of the elastic member 26 is biased against the annular flange member 27. The elastic member 26 is a washer.

A casing 30 includes a rim 31 extending out of a forward end, a plurality of spaced second ridges 32 disposed on the rim 31 and configured to secure to the first ridges 11 by snapping, a channel 33 through the casing 30 with the hollow cylinder 212 disposed therein, and an annular well 34 disposed on an inner surface of a rear end.

A lipstick tube 40 is disposed in the casing 30 and includes a rotational member 41 proximate a rear end, a tunnel 43 through the lipstick tube 40, two opposite curved protrusions 44 disposed on an inner surface of the tunnel 43 at the rear end, two gaps 45 each disposed between one ends of the protrusions 44 or between the other ends of the protrusions 44, and two raised blocks 46 each disposed on the protrusion 44 adjacent to the gap 45.

A joining device 50 includes a plurality of spaced projections 51 formed on a cylindrical forward extension and configured to dispose in the annular well 34, and an annular first shoulder 52 at a rear end.

A locking device 60 includes an annular seat 61, an axial member 62 extending out of a forward end of the annular seat 61, two opposite protuberances 63 formed on the axial member 62 with the raised blocks 46 fastened between protuberances 63 and the annular seat 61, a shaped member 64 formed on a rear end of the annular seat 61, and an axial shaft 65 rearward extending out of a central portion of the shaped member 64.

A base 70 includes an annular second shoulder 71 configured to secure to the annular first shoulder 52 by snapping, an internally shaped projecting member 72 on a central portion of a bottom and configured to secure to the shaped member 64 by snapping, and a hole 73 through a center of the internally shaped projecting member 72 with the axial shaft 65 fastened therein. Thus, the base 70 and the locking device 60 are releasably secured together.

Figure 5:
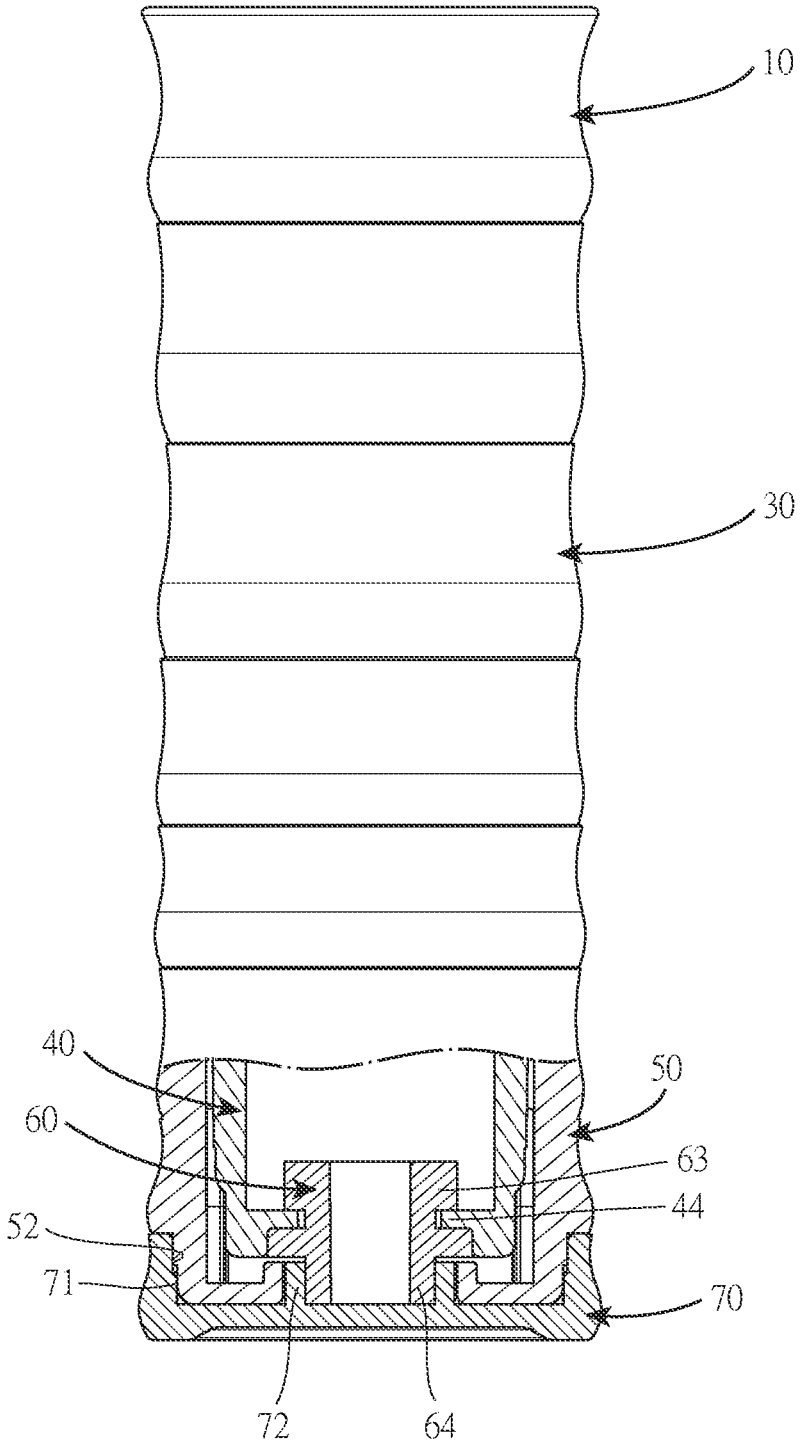
FIG. 5 is a side elevation in part section showing the locking device and the base.

Alternatively, both the internally shaped projecting member 72 and the shaped member 64 are cylindrical and can be fastened together by ultrasonic welding (see FIG. 5).

As shown in FIGS. 2 to 4 and 14 specifically, in use a user may press the mirror 25 which in turn presses both the transparent recessed member 22 and the pushbutton 215. The switch 214 is thus closed (i.e., on) to electrically connect the battery 24 to the light-emitting members 23 which are in turn activated to emit light. The transparent blocks 225 urge against the light-emitting members 23 so that more light can be emitted by the light-emitting members 23. Finally, the light is directed to illuminate a desired target.

After use, the user may press the mirror 25 again and in turn the mirror 25 presses both the transparent recessed member 22 and the pushbutton 215. The switch 214 is thus open (i.e., off) to electrically disconnect the battery 24 from the light-emitting members 23. As a result, the light-emitting members 23 are deactivated.

As shown in FIGS. 6 to 8 specifically, in a configuration of the first preferred embodiment the switch 214 is eliminated, and both the conductive member 217 and the elastic member 26 are disposed. In use, the user may press the mirror 25 which in turn presses the transparent recessed member 22. The trigger member 227 is activated to press the elastic member 26 and in turn the trigger block 228 contacts the conductive member 217. Thus, the battery 24 is electrically connected to the light-emitting members 23 which are in turn activated to emit light. The annular member 226 urges against the light-emitting members 23 so that more light can be emitted by the light-emitting members 23. Finally, the light is directed to illuminate a desired target.

A replacement of the consumed lipstick tube 40 involves the steps of disengaging the casing 30 from the joining device 50, holding the joining device 50 to rotate the base 70 until the base 70 co-rotates with the locking device 60, moving the protuberances 63 into the gaps 45, pulling the lipstick tube 40 out of both the locking device 60 and the joining device 50, and replacing the lipstick tube 40 with a new one.

A replacement of the consumed battery 24 involves the steps of rotating the rotational cylindrical shell 10 to disengage the illumination assembly 20 from the casing 30, taking the consumed battery 24 out of the receiving space 213, and replacing the battery 24 with a new one.

Figure 11:
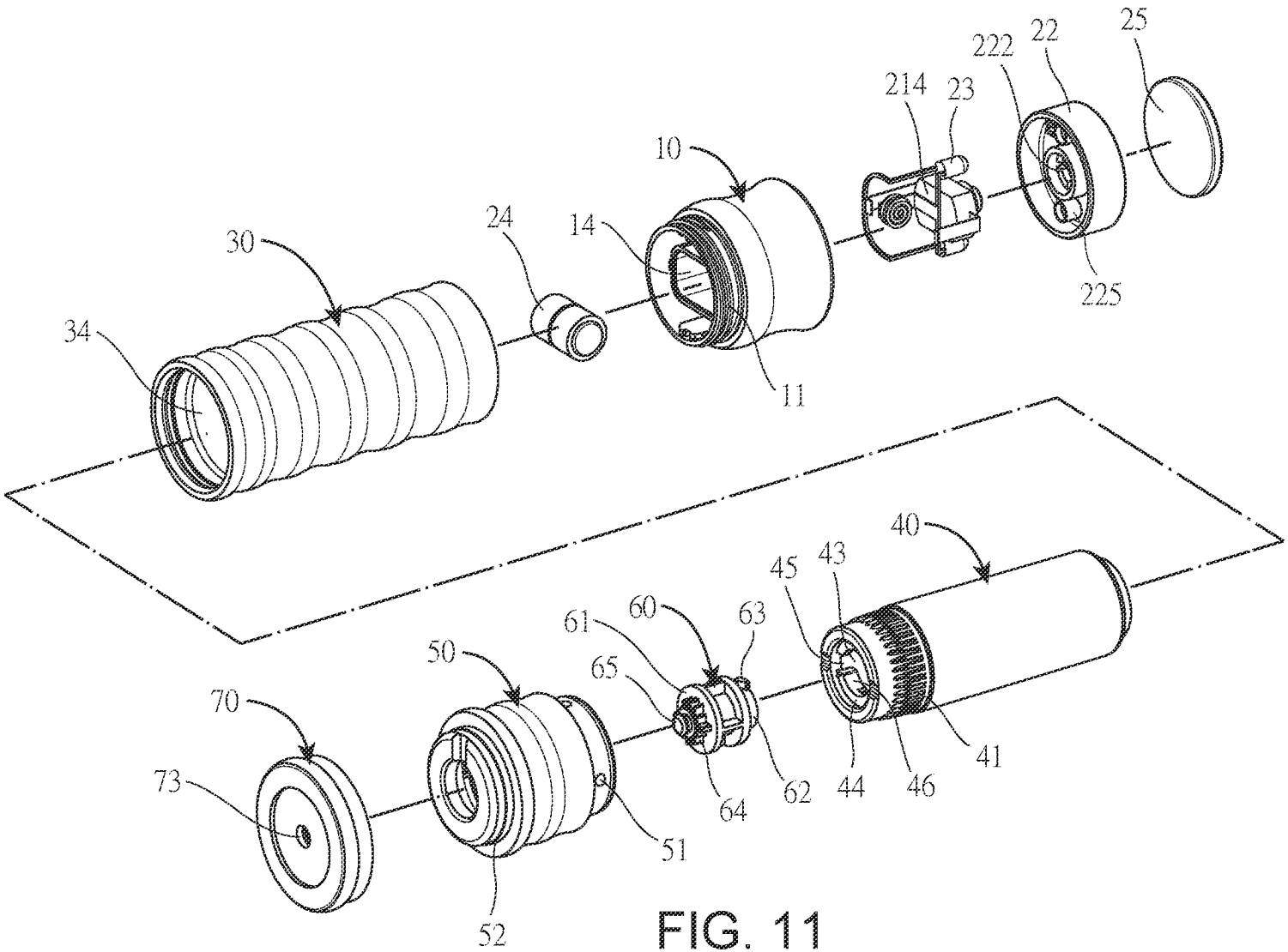
FIG. 11 is an exploded view of a lipstick container in accordance with a second preferred embodiment the invention.
Figure 12:
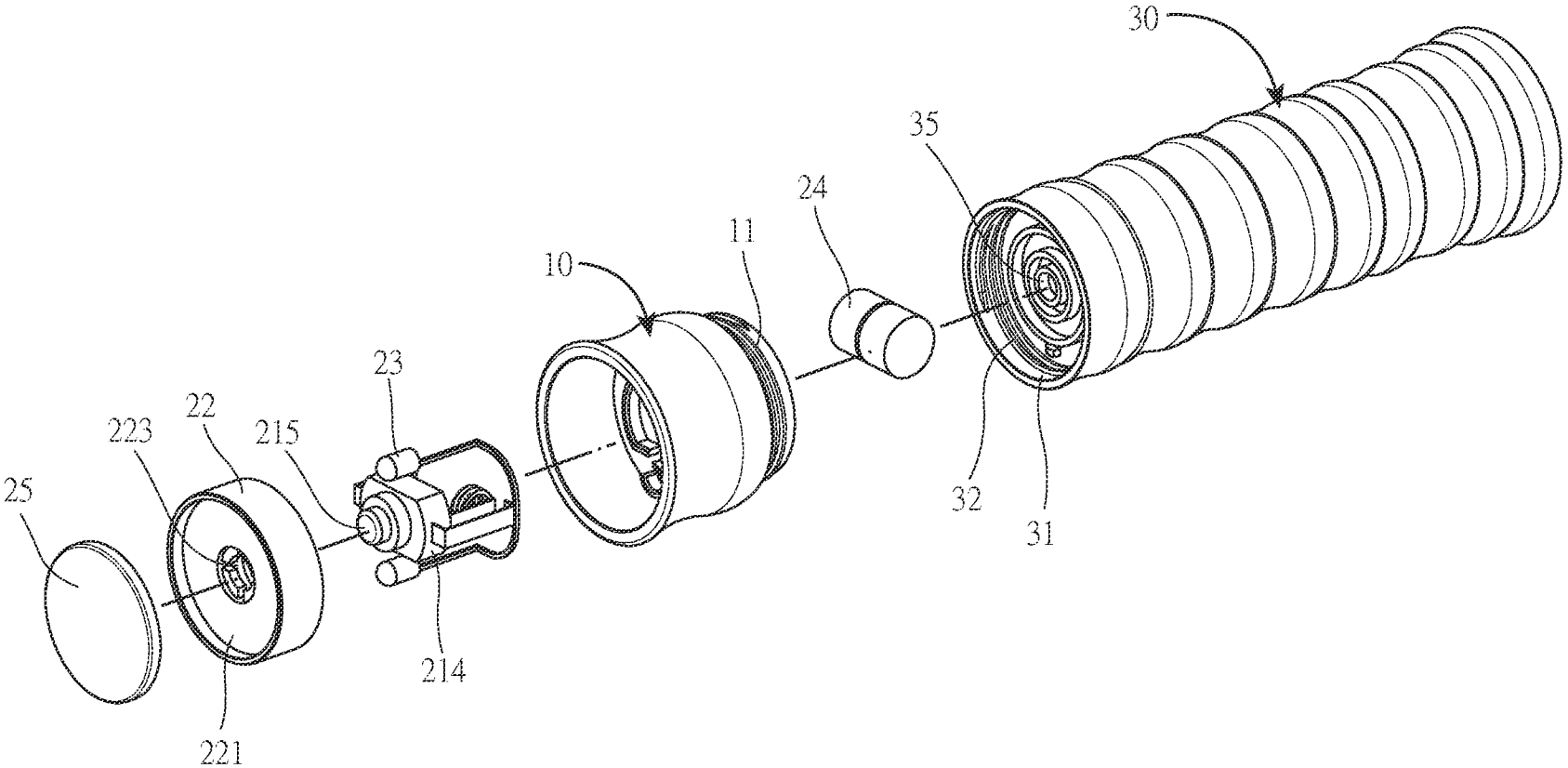
FIG. 12 is an exploded view of some components of the lipstick container in FIG. 11.
Figure 13:
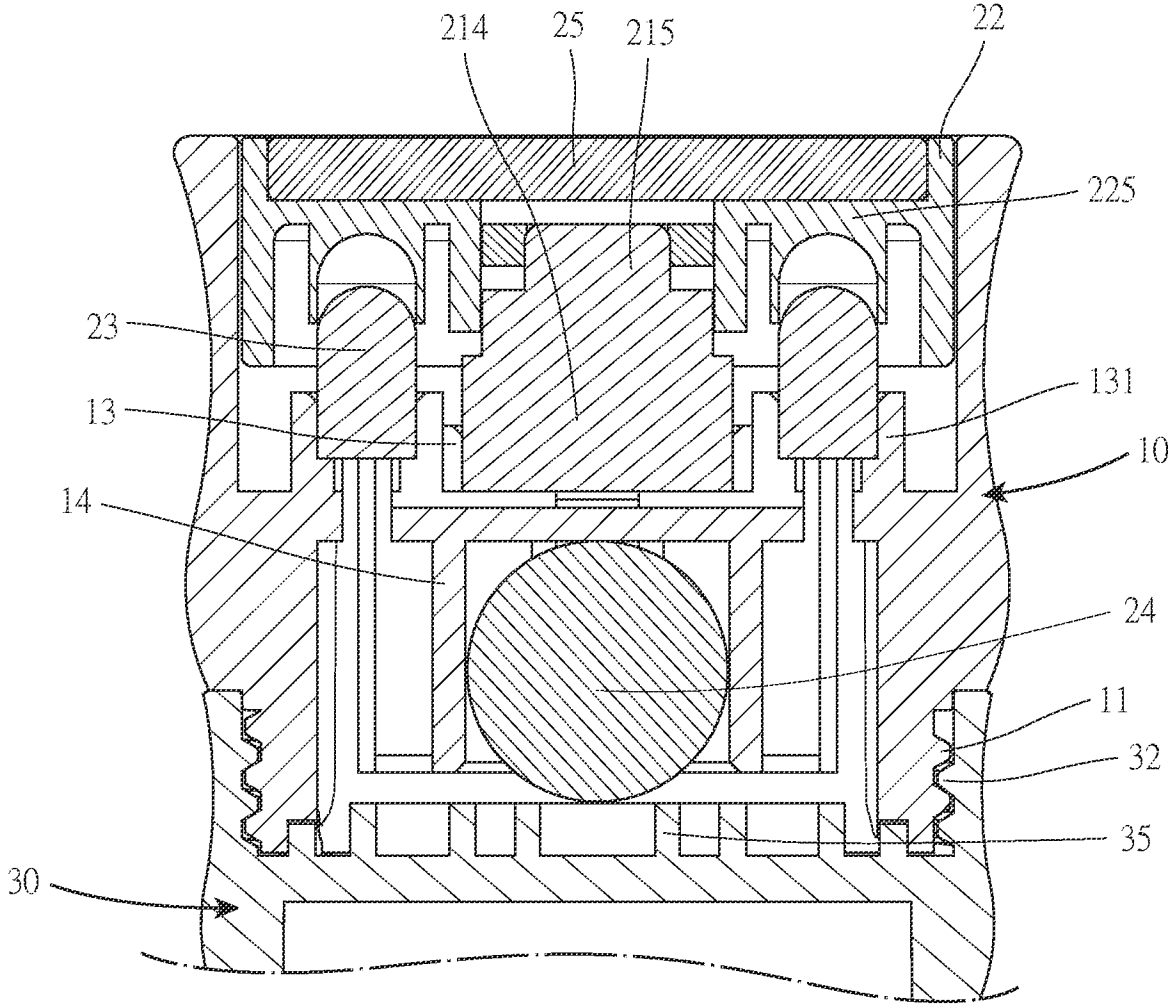
FIG. 13 is a longitudinal sectional view of an upper portion of the assembled lipstick container in FIG. 11.
Figure 14:
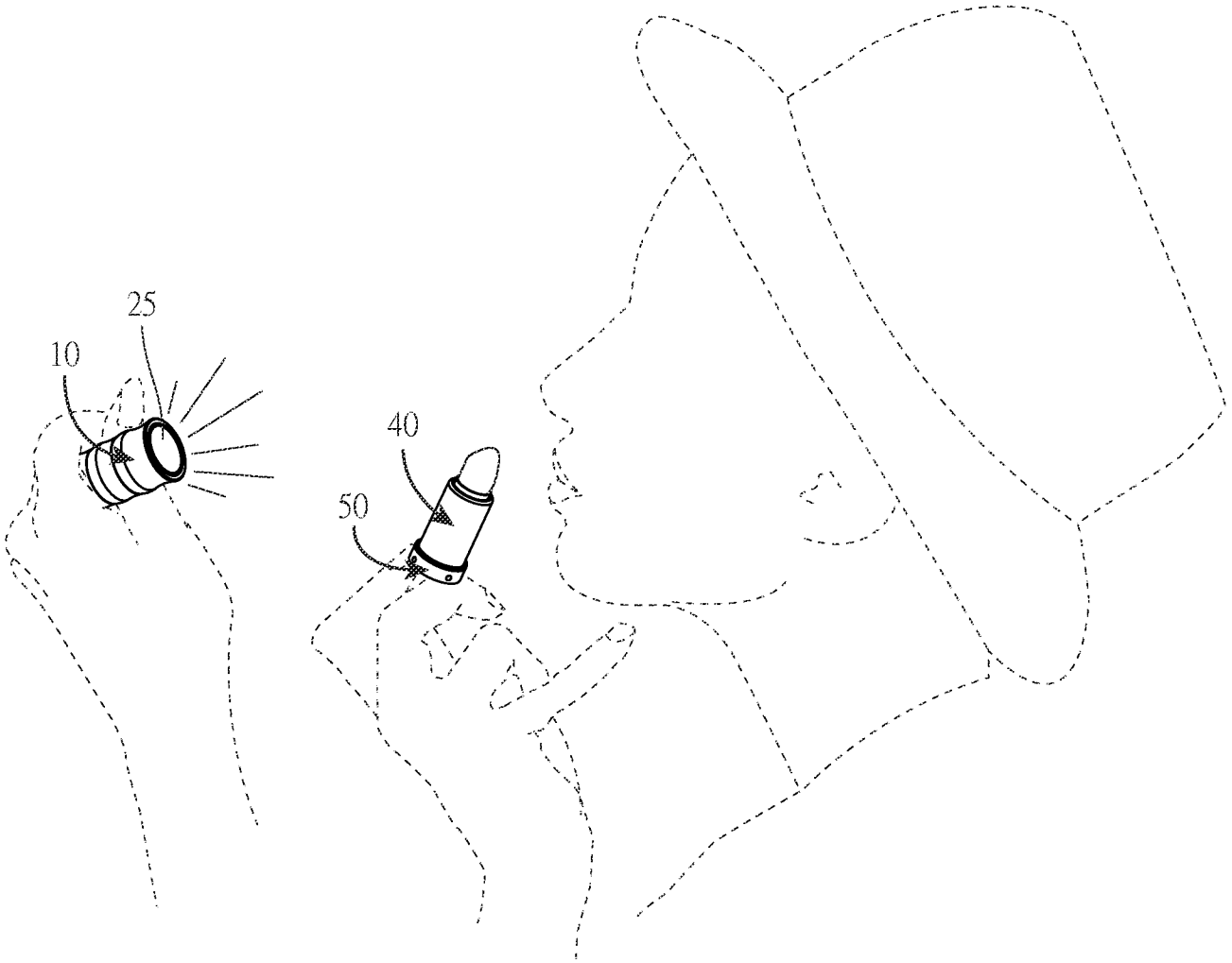
FIG. 14 schematically shows an environment of using the lipstick container of the invention.

Referring to FIGS. 11 to 13, a lipstick container in accordance with a second preferred embodiment of the invention is shown. The characteristics of the second preferred embodiment are substantially the same as that of the first preferred embodiment except the following:

The illumination assembly 20 does not have a battery receptacle 21. The rotational cylindrical shell 10 includes an internal groove 13 at an end. The switch 214 is fastened in the internal groove 13. A receptacle 131 is provided at either side of the internal groove 13. The rotational cylindrical shell 10 further comprises a plurality of annular first ridges 11 on an outer surface at a rear end and an internal trough 14 with the battery 24 disposed therein. Two opposite light-emitting members 23 are provided on the switch 214. The switch 214 is electrically interconnected the light-emitting members 23 and the battery 24. A rear portion of the light-emitting member 23 is fastened in the receptacle 131 and a forward portion thereof is disposed in the transparent block 225. The casing 30 includes a plurality of annular second ridges 32 on an inner surface of the rim 31 at a forward end. The annular second ridges 32 are releasably secured to the annular first ridges 11. An annular member 35 is provided in the rim 31. An outer surface of the battery 24 urges against the annular member 35.

While the invention has been described in terms of preferred embodiments, those skilled in the art will recognize that the invention can be practiced with modifications within the spirit and scope of the appended claims.

What is claimed is:

1. A lipstick container, comprising:

a rotational shell including a plurality of spaced first ridges on an inner surface;

an illumination assembly including a battery receptacle disposed in the rotational shell and having a disc-shaped member, a hollow cylinder formed with the disc-shaped member, a receiving space disposed in the hollow cylinder; at least one light-emitting member disposed on a first surface of the disc-shaped member; a battery disposed in the receiving space and electrically connected to the at least one light-emitting member; a transparent recessed member disposed in the rotational shell and above the battery receptacle; and a mirror disposed in the transparent recessed member;

a casing including a rim extending out of a forward end, a plurality of spaced second ridges disposed on the rim and configured to secure to the first ridges, a channel disposed through the casing with the hollow cylinder disposed therein, and a well disposed on an inner surface of a rear end;

a lipstick tube disposed in the casing and including a rotational member proximate a rear end, a tunnel disposed through the lipstick tube, two opposite curved protrusions disposed on an inner surface of the tunnel at the rear end, two gaps each disposed between first ends of the curved protrusions or between second ends of the curved protrusions, and two raised blocks each disposed on the curved protrusion adjacent to the gap;

a joining device including a plurality of spaced projections formed on a forward extension and configured to dispose in the well, and a first shoulder at a rear end;

a locking device including a seat, an axial member extending out of a forward end of the seat, two opposite protuberances formed on the axial member with the raised blocks fastened between the opposite protuberances and the seat, and a shaped member formed on a rear end of the seat; and a base including a second shoulder configured to secure to the first shoulder, and an internally shaped projecting member disposed on a bottom and configured to secure to the shaped member.

2. The lipstick container of claim 1, wherein the rotational shell further comprises a groove on the inner surface adjacent to the first ridges; wherein the disc-shaped member is fastened in the groove; wherein the illumination assembly further comprises a switch disposed on a first surface of the disc-shaped member adjacent to the at least one light-emitting member, a pushbutton disposed on the switch, and two opposite urging surfaces disposed on the switch; wherein the switch is electrically interconnected the at least one light-emitting member and the battery; and wherein the transparent recessed member further comprises a shallow recess on a first surface with the mirror disposed therein, an annular flange disposed on a central portion of a second surface, a space disposed in the annular flange with the pushbutton disposed therein, two opposite fastening plates disposed on an outer surface of the annular flange and urging against the urging surfaces respectively, and at least one transparent block aligned with the at least one light-emitting member respectively.

3. The lipstick container of claim 1, further comprising a conductive member disposed on a central portion of the disc-shaped member, an annular member disposed on a second surface of the transparent recessed member, a trigger member disposed in a central portion of the annular member, a raised trigger block disposed on the trigger member and aligned with the conductive member, and an annular trough disposed between the annular member and the trigger member.

4. The lipstick container of claim 3, further comprising at least one elastic member disposed on the conductive member wherein the at least one elastic member is biased between a bottom of the annular trough and a surface of the disc-shaped member.

5. The lipstick container of claim 3, further comprising at least one elastic member biased against a first surface of the disc-shaped member and spaced around the conductive member wherein the at least one elastic member is further biased against a surface of the annular member.

6. The lipstick container of claim 3, further comprising at least one elastic member having a first surface biased against the disc-shaped member, and an annular flange member disposed on an edge of the annular member wherein a second surface of the at least one elastic member is biased against the annular flange member.

7. The lipstick container of claim 1, further comprising an axial shaft rearward extending out of a central portion of the shaped member, and a hole disposed through a center of the internally shaped projecting member with the axial shaft fastened therein.

8. The lipstick container of claim 1, wherein both the internally shaped projecting member and the shaped member are cylindrical and are configured to fasten together by ultrasonic welding.

9. A lipstick container, comprising:

a rotational shell including an internal groove at an end, a plurality of spaced first ridges on an outer surface, an internal trough, and a battery disposed in the internal trough;

an illumination assembly including a switch disposed in the internal groove, at least one light-emitting member disposed on a surface of the switch, a transparent recessed member disposed in the rotational shell, and a mirror disposed in the transparent recessed member wherein the switch is electrically interconnected the at least one light-emitting member and the battery;

a casing including a rim extending out of a forward end, a plurality of spaced second ridges disposed on an inner surface of the rim and configured to secure to the first ridges, an annular member disposed in the rim, and a well disposed on an inner surface of a rear end wherein an outer surface of the battery urges against the annular member;

a lipstick tube disposed in the casing and including a rotational member proximate a rear end, a tunnel disposed through the lipstick tube, two opposite curved protrusions disposed on an inner surface of the tunnel at the rear end, two gaps each disposed between first ends of the curved protrusions or between second ends of the curved protrusions, and two raised blocks each disposed on the curved protrusion adjacent to the gap;

a joining device including a plurality of spaced projections formed on a forward extension and configured to dispose in the well, and an first shoulder at a rear end;

a locking device including a seat, an axial member extending out of a forward end of the seat, two opposite protuberances formed on the axial member with the raised blocks fastened between the opposite protuberances and the seat, and a shaped member formed on a rear end of the seat; and a base including an second shoulder configured to secure to the first shoulder, and an internally shaped projecting member disposed on a bottom and configured to secure to the shaped member.

10. The lipstick container of claim 9, wherein the internal groove includes at least one receptacle at either side with a rear portion of each of the at least one light-emitting member fastened in each of the at least one receptacle; wherein the transparent recessed member further comprises a shallow recess on a first surface with the mirror disposed therein, an annular flange disposed on a central portion of a second surface; wherein the transparent recessed member includes a transparent block on the annular flange and aligned with each of the at least one light-emitting member; and wherein a forward portion of each of the at least one light-emitting member is disposed in the transparent block.

11. The lipstick container of claim 9, further comprising an axial shaft rearward extending out of a central portion of the shaped member, and a hole disposed through a center of the internally shaped projecting member with the axial shaft fastened therein.

12. The lipstick container of claim 9, wherein both the internally shaped projecting member and the shaped member are cylindrical and are configured to fasten together by ultrasonic welding.

* * * * *